US010709629B2

(12) United States Patent
Sabota

(10) Patent No.: US 10,709,629 B2
(45) **Date of Patent: *Jul. 14, 2020**

(54) INFANT WARMING DEVICE WITH IN BED PATIENT SUPPORT POWER, SIGNAL, CONTROL, DATA, AND COMMUNICATIONS

(71) Applicant: SEGARS CALIFORNIA PARTNERS, LP, Austin, TX (US)

(72) Inventor: Peter D. Sabota, Austin, TX (US)

( * ) Notice: Subject to any disclaimer, the term of this patent is extended or adjusted under 35 U.S.C. 154(b) by 257 days.

This patent is subject to a terminal disclaimer.

(21) Appl. No.: 15/882,739

(22) Filed: Jan. 29, 2018

(65) Prior Publication Data

US 2018/0147103 A1 May 31, 2018

Related U.S. Application Data

(63) Continuation of application No. 14/773,367, filed as application No. PCT/US2014/029919 on Mar. 15, 2014, now Pat. No. 9,889,055.

(60) Provisional application No. 61/835,521, filed on Jun. 14, 2013, provisional application No. 61/788,480, filed on Mar. 15, 2013.

(51) Int. Cl.
*A61G 11/00* (2006.01)
*A61G 13/10* (2006.01)

(52) U.S. Cl.
CPC ..... *A61G 11/00* (2013.01); *A61G 11/003* (2013.01); *A61G 13/107* (2013.01); *A61G 2203/20* (2013.01)

(58) Field of Classification Search
CPC ..... A61G 11/00; A61G 11/001–009; A61G 13/107; A47B 21/06; A47B 2097/003
See application file for complete search history.

(56) References Cited

U.S. PATENT DOCUMENTS

| | | | | |
|---|---|---|---|---|
| 3,306,287 | A | 2/1967 | Arp et al. | |
| 4,936,824 | A | 6/1990 | Koch et al. | |
| 5,067,188 | A | 11/1991 | Brantman | |
| 5,095,561 | A | 3/1992 | Green et al. | |
| 5,282,284 | A | 2/1994 | Brantman et al. | |
| 5,376,761 | A | 12/1994 | Koch et al. | |
| 5,381,569 | A | 1/1995 | Church | |
| 5,497,518 | A | 3/1996 | Iura | |
| 5,531,663 | A | 7/1996 | Gloyd et al. | |
| 6,074,340 | A | 6/2000 | Sweeney et al. | |
| 6,155,970 | A | 12/2000 | Dykes et al. | |
| 6,457,196 | B1 | 10/2002 | Dykes et al. | |
| 9,486,377 | B2 | 11/2016 | Dmello et al. | |
| 2004/0186341 | A1* | 9/2004 | McDermott | G16H 40/63 600/22 |
| 2008/0225534 | A1* | 9/2008 | Rus | F16G 13/16 362/404 |

(Continued)

FOREIGN PATENT DOCUMENTS

| | | |
|---|---|---|
| EP | 2221036 | 8/2010 |
| WO | 2009131936 | 10/2009 |

OTHER PUBLICATIONS

Brochure—Phoenix Medical Systems "Neonatal Open Care System" Phoenix 100 NRC.

*Primary Examiner* — Carrie R Dorna
(74) *Attorney, Agent, or Firm* — Barnes & Thornburg LLP

(57) ABSTRACT

An electrical connection system that can feed power, signal, data, and communication lines into a rotating patient support system in a infant warming device.

14 Claims, 5 Drawing Sheets

(56) References Cited

U.S. PATENT DOCUMENTS

2010/0222638 A1 9/2010 Chilton

* cited by examiner

INFANT WARMING DEVICE WITH IN BED PATIENT SUPPORT POWER, SIGNAL, CONTROL, DATA, AND COMMUNICATIONS

CROSS-REFERENCE TO RELATED APPLICATIONS

This application is a continuation of U.S. patent application Ser. No. 14/773,367, now U.S. Pat. No. 9,889,055, which was the national stage entry of International Application No. PCT/US14/29919, which was filed on Mar. 15, 2014 and claimed the benefit of U.S. Provisional applications 61/788,480 filed Mar. 15, 2013 and 61/835,521 filed Jun. 14, 2013. The entirety of each of those applications is incorporated by reference.

BACKGROUND

This disclosure relates to the field of various infant warming devices that are used to provide heat support to premature infants who cannot sustain their own body temperature. In the treatment of infants, and particularly those born prematurely, it is necessary to provide heat to the infant during the care and treatment of the infant and to minimize heat loss from the infant's body. An apparatus for providing such heat will be referred to in this disclosure as an infant warming device. In general such an apparatus comprises a flat planar surface on which the infant rests while various procedures are carried out. There are normally protective guards or hoods that surround the infant and some type of heater directing energy toward the infant. This heating could be radiant in the case of an infant warmer, or heated air in the case of an infant incubator or combination device. These devices are frequently mounted on a mobile system that can easily be rolled around in a hospital environment. It should be understood that these infant warming devices might have other descriptive names, such as, for example, an infant care device, or an infant warming center, and this disclosure anticipates any of those other names.

Above and beyond these basic functions of an infant warming device there are many other functions that can be useful for infant care. This disclosure will describe one of those.

Infant warming devices currently have all external communications, sensors, power, and data to the device located on the main device structure. These connections are connected to various control systems such temperature probes, SpO2 probes, monitoring probes, etc. which are then attached with wire and cables that hang over the bed and the patient. These connection arrangements can create problems for caregivers as they create a cluttered environment around the infant warming device.

There is a need then for a system that enables the connection and operation of the entire probe and signal electronics, power system, ancillary equipment etc., so they can now operate without hanging over the bed and the patient and all cables can be shortened and the patient environment de-cluttered.

Many infant warming devices currently have beds that are capable of rotation to orient the patient to different positions without having to move the patient itself. These systems that rotate the patient support mattress tray are limited in use because patients are electrically connected to various control systems such temperature probes, SpO2 probes, monitoring probes, etc. which can limit the ability to easily rotate the patient or the bed. Additionally, other equipment and ancillary systems are often uses that require signal, data, power which also limit the ability to easily rotate the patient or bed.

There is a need then for systems that enable easy movement of these beds in various orientations without being limited by the need to maintain electrical power and data communication linkages.

BRIEF SUMMARY

This need can be met by incorporating an electrical connection that can route power, signal, data, and communication lines into the patient support system. The patient probe and signal electronics, power system, ancillary equipment etc. can now operate without restriction hanging over the bed and patient and all cables can be shortened and the patient environment decluttered. Examples of such equipment includes but is not limited to, temperature probes, SpO2 probes, Patient monitoring leads, patient weight scales, heated mattresses, phototherapy systems, trans-illumination systems, and other ancillary equipment which could be added to the device or also now be able to be built into the device permanently without cabling restrictions.

Some patient support systems also have the ability to rotate to facilitate the care of the infant. There then is also a need to allow such movement of the patient support system without any cabling restrictions. Meeting both of these needs will be described in this disclosure.

The need to remove cabling restrictions in rotating systems can be met by incorporating an electrical connection that can rotate power, signal, data, and communication lines into the rotating patient support system. The patient probe and signal electronics, power system, ancillary equipment etc. can now rotate with the entire patient support structure without restriction of movement. This allows the ability to rotate any internal or external equipment with the patient support/bed. Examples of such equipment includes but is not limited to, temperature probes, SpO2 probes, Patient Monitoring leads, patient weight scales, heated mattresses, phototherapy systems, trans-illumination systems, and other ancillary equipment which could be added to the device or also now be able to be built into the device permanently and still be able to be rotated with the patient without affecting cabling.

The need can be met by an infant warming device including a patient bed, supporting sidewalls, associated warming mechanisms, and a main controller; including at least: an integral patient support mechanism underlying and supporting the patient bed containing critical electronics for providing some or all of power, signal, control, data and communications between the patient bed and the main controller; a cable connection located in the integral patient support mechanism; wherein all cabling for power, signal, control, data, and communications to and from the patient, sensors, ancillary equipment or device electronics are routed down from the patient bed through the cable connection.

DESCRIPTION OF DRAWINGS

There are disclosed in the drawings and detailed description to follow various embodiments of the solution proposed herein. It should be understood, however, that the specific embodiments given in the drawings and entailed description do not limit the disclosure. On the contrary, they provide the foundation for discerning the alternative forms, equivalents, and modifications that will be encompassed in the scope of the eventual claims.

DETAILED DESCRIPTION

Figure 1:
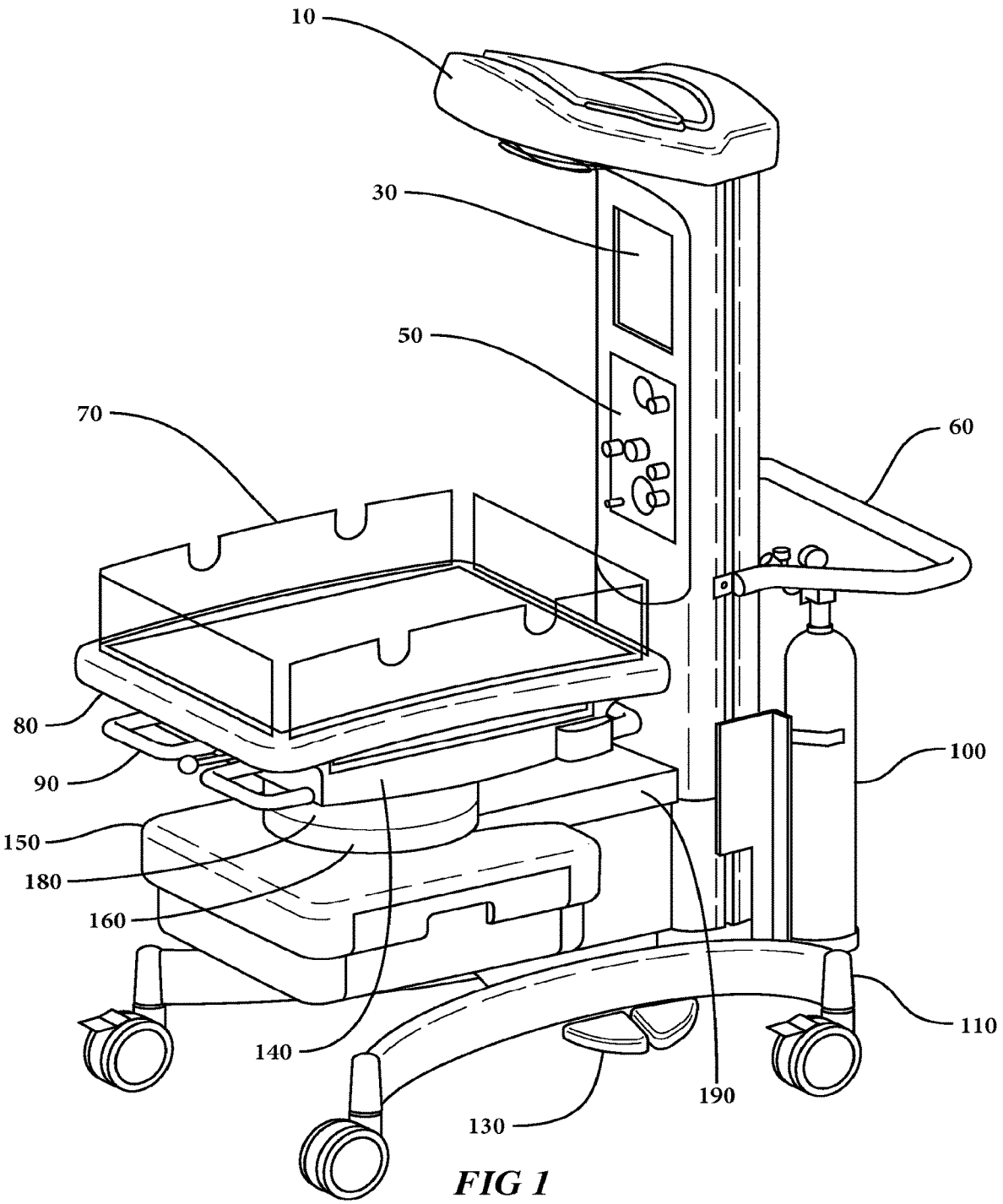
FIG. 1 is a view of an infant warming device that can include the inventive concept described in this disclosure.
Figure 2:
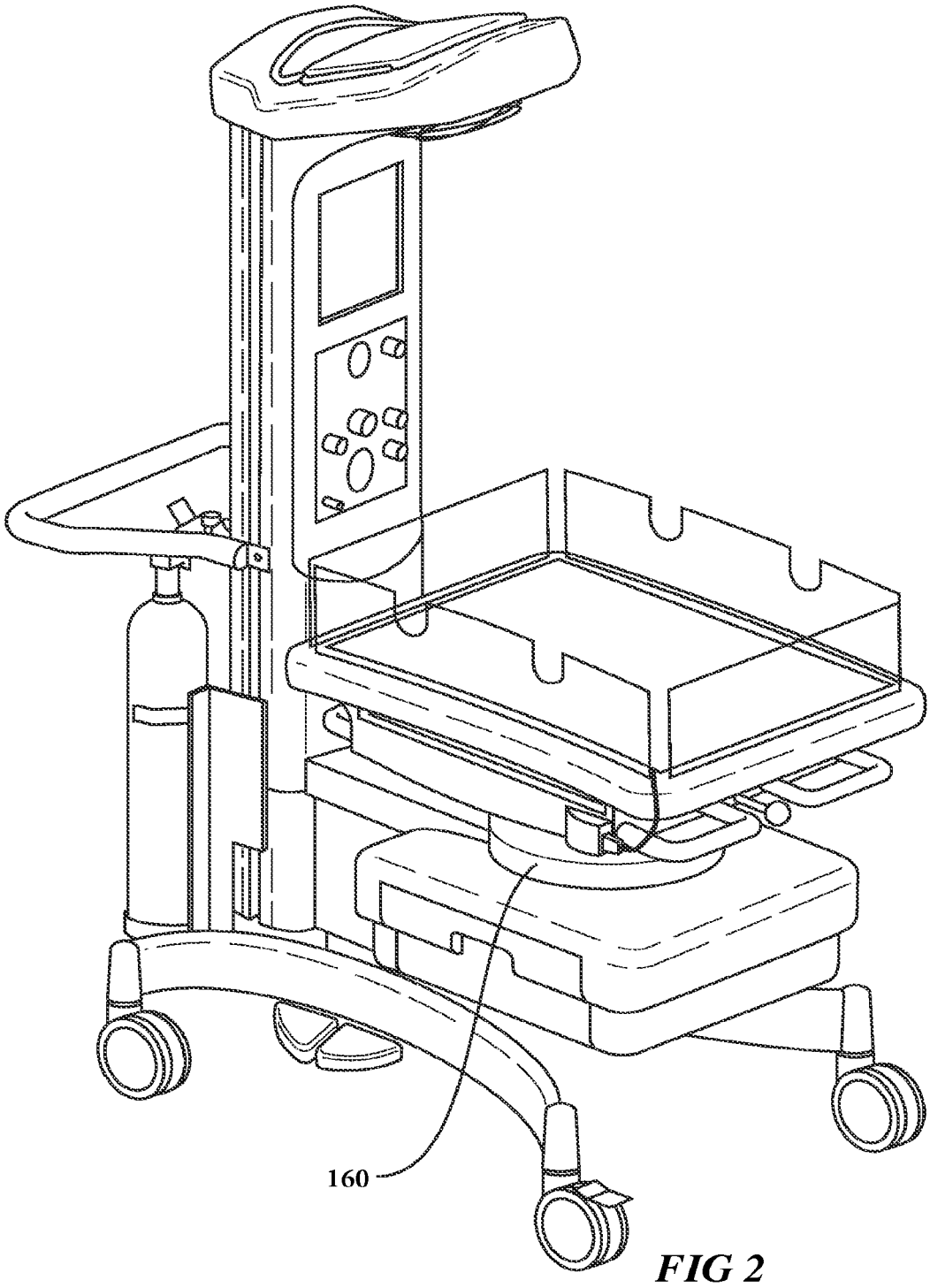
FIG. 2 is an alternate view of an infant warming device that can include the inventive concept described in this disclosure.
Figure 3:
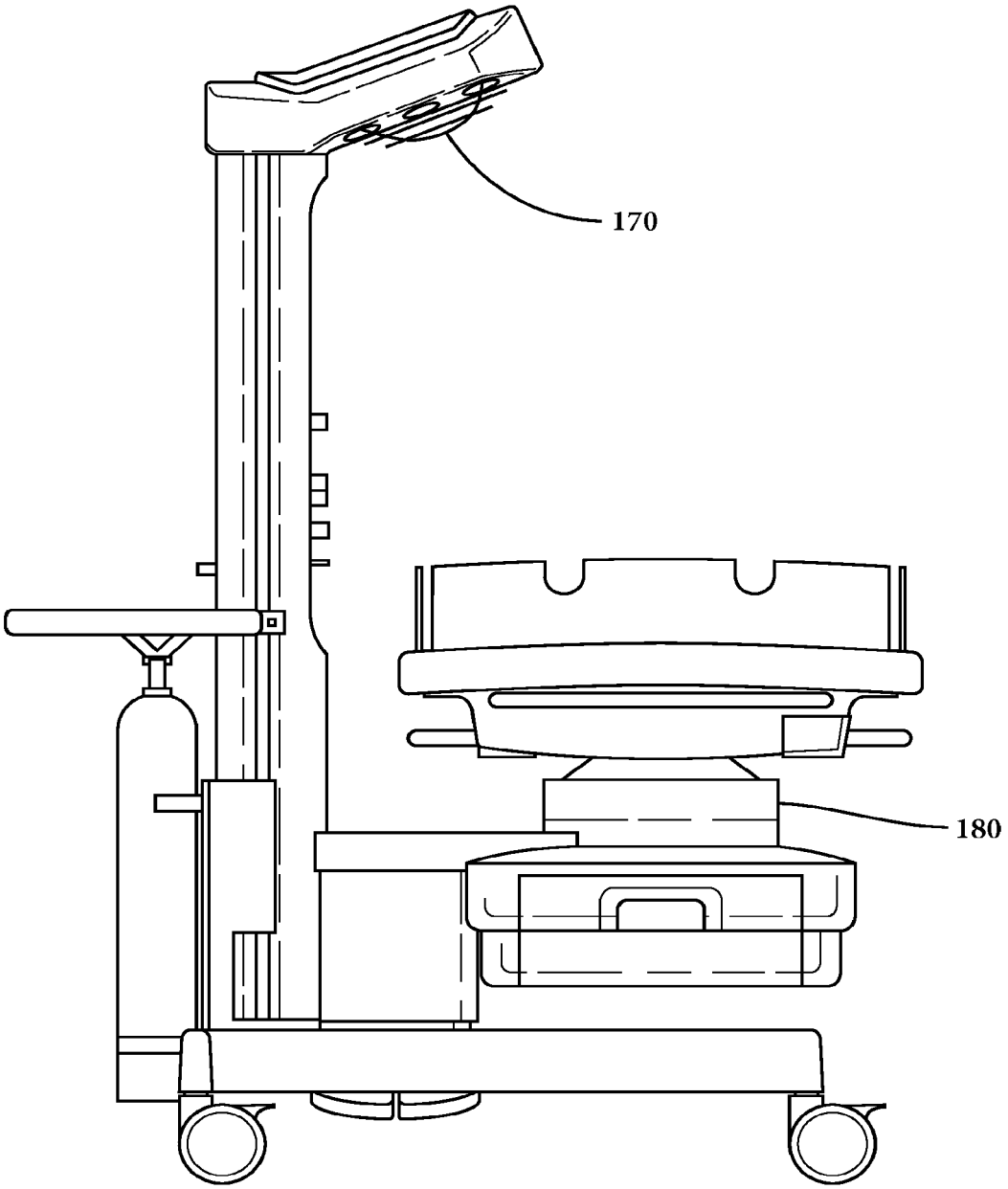
FIG. 3 is an alternate view of an infant warming center that can include the inventive concept described in this disclosure.

Referring now to FIGS. 1, 2, and 3, several views of an infant warming center that can include the inventive concept to be described in this disclosure. The center includes an infant bed 80 that underlies an infant positioned thereon. The infant bed has a surrounding sidewall 70 and rides upon a patient support mechanism 140. The patient bed and surrounding sidewalls may enclose a heated mattress. A vertical column structure mounted on the infant warming center supports a radiant heater head 10, containing a radiant heater 170 (FIG. 3), The radiant heater assembly is designed to optimize the heat focused on the infant. The vertical column structure may have a graphic display user interface 30 and a resuscitation module 50. The infant warming device's main computer controller may reside in the vertical column structure or may reside in the patient support mechanism. Handles 60, 90, are used to move the infant warming device around as it can be moved on flat surfaces via legs 110 with attached wheels and controlled with footswitches 130. On the rear side of the column is a location for carrying a remote gas supply tank 100. Under the patient support mechanism 140 is a cantilever cover 160 and turret cover 180 for shrouding the rotation mechanisms with a cantilever arm that supports the patient support, vertical column, and supports a storage enclosure 150.

Figure 4:
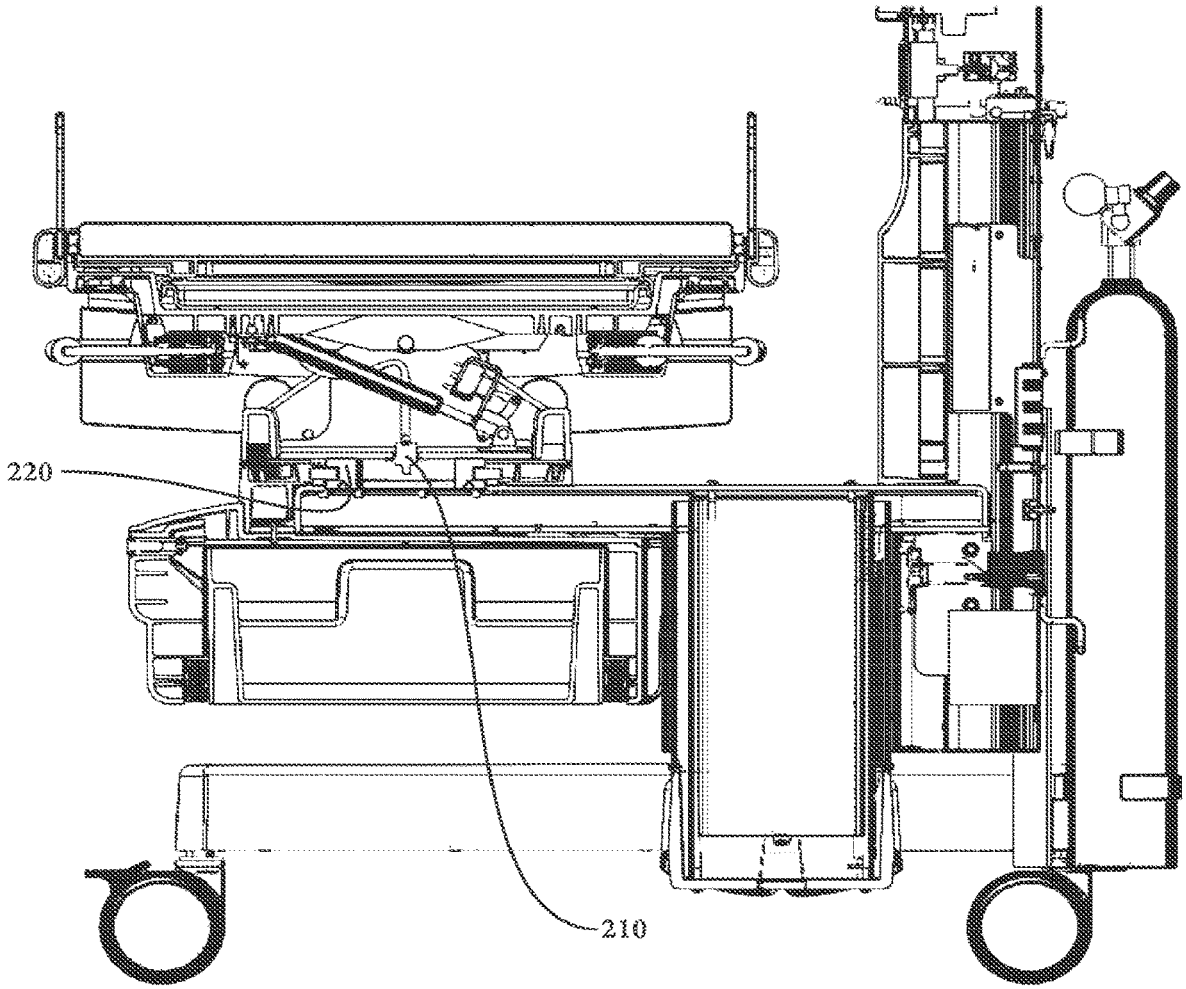
FIG. 4 is a view of the configuration of the patient support assembly.

Shown in FIG. 4 is a more detailed view of the patient support mechanism 140 This mechanism houses all of the power, signal, control, data, and communications lines and enables all hardware either permanently attached to the bed or connected to the bed through separate external connections to be free from issue of tangling cables, risk of pulling off patient probes or leads, or moving equipment powered or controlled elsewhere. All of the power, signal, data, and communication lines into the patient support mechanism, whether coming from the infant warming controller or sensor data from the patient, pass through a single cable connection 210 located below the bed. This allows, critical electronics to be permanently mounted in the patient support structure below the bed rather than above the patient and enables passing back data to the main controller that can be located in the vertical column structure of the infant warming center and allows a better control response and reduces system latencies.

Figure 5:
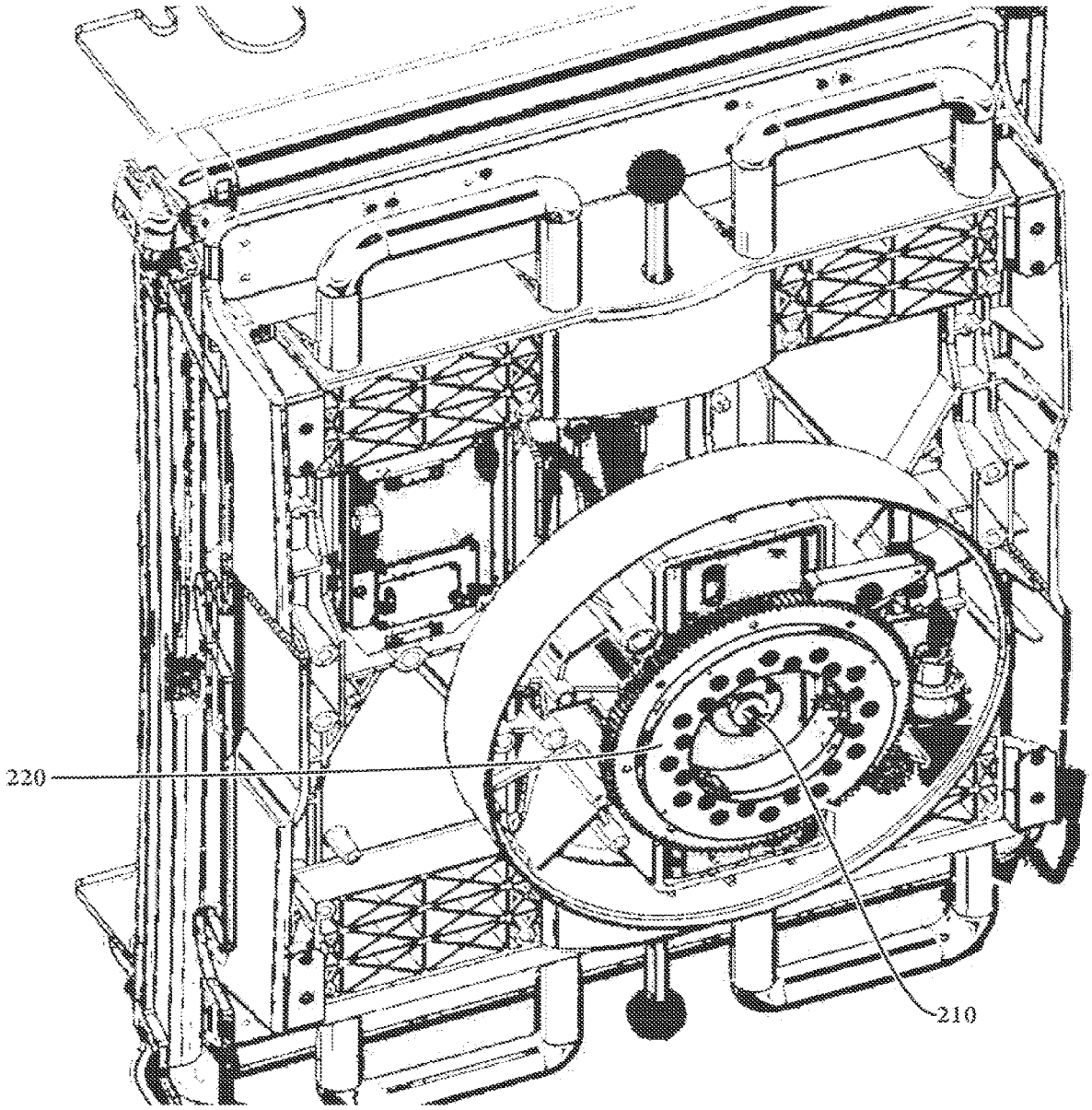
FIG. 5 is a bottom view of the patient support assembly and cable connection.

FIG. 5 is a bottom view of the patient support mechanism illustrating the cable connection 210 through which the cabling passes.

In one embodiment of this disclosure the patient support mechanism is not rotatable and the cabling simply passes through cable connection 210 and is then connects and communicates to the electronics in the patient support mechanism and thereby to the main controller of the infant warming center.

In a second embodiment the patient support mechanism is rotatable to allow improved access to the infant bed and patient during care. In this embodiment the rotating patient support mechanism utilizes a slip ring inside of a rotation bearing to pass through all power, signal, control, data, and communications lines which allows rotation of the bed and all hardware either permanently attached to the bed or connected to the bed through separate external connections which allows the patient be to be rotated without issues of tangling cables, pulling off patient probes or leads, or moving equipment powered or controlled by the bed. FIG. 5 shows now a slip ring 210 inside rotation bearing 220. In this embodiment critical electronics can still be permanently mounted in patient support structure 140 and pass data back to the main controller via slip ring 210 that allows better control response and reduces system latencies. This disclosure anticipates either a static or rotatable patient support mechanism and either solves the stated problem of removing the cabling clutter inherent in other infant warming designs.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

What is claimed is:

1. An infant care device, comprising:

a wheeled base, a vertical column coupled to the wheeled base, the vertical column housing a main controller, a patient bed assembly including electronic hardware for use in caring for a patient, a rotatable patient support mechanism coupled to the patient bed assembly, the patient support mechanism including electronics for providing at least one of a power, signal, control, data, and communication line for the electronic hardware of the patient bed assembly, and a cable connection coupled to the at least one of the power, signal, control, data, and communication line, the cable connection including a slip ring located in the patient support mechanism, and cables connecting the slip ring to the main controller, wherein the patient support mechanism is operable to rotate the patient bed assembly relative to the wheeled base, and the slip ring is configured to permit rotation of the patient bed assembly without tangling the cables and the at least one of a power, signal, control, data, and communication line.

2. The infant warming device of claim 1, further comprising a heated mattress deployed in the patient bed assembly.

3. The infant care device of claim 1, further comprising a radiant heater head containing a radiant heater assembly.

4. The infant care device of claim 1, further comprising a graphic display user interface mounted in the vertical column.

5. The infant care device of claim 1, wherein the patient bed assembly includes an infant bed and a surrounding sidewall.

6. An infant care device, comprising:

a wheeled base, a main controller, a patient bed assembly including electronic hardware for use in caring for a patient, a rotatable patient support mechanism coupled to the patient bed assembly, the patient support mechanism including electronics for providing power, signal, control, data, and communication lines for the electronic hardware of the patient bed assembly, and a cable connection coupled to the power, signal, control, data, and communication lines, the cable connection including a slip ring located in the patient support mechanism, and cables connecting the slip ring to the main controller, wherein the patient support mechanism is operable to rotate the patient bed assembly relative to the main controller, and the slip ring is configured to permit rotation of the patient bed assembly without tangling the cables and the power, signal, control, data, and communication lines.

7. The infant care device of claim 6, further comprising a heated mattress deployed in the patient bed assembly.

8. The infant care device of claim 6, further comprising a radiant heater head containing a radiant heater assembly.

9. The infant care device of claim 6, further comprising a graphic display user interface.

10. The infant care device of claim 6, wherein the patient bed assembly includes an infant bed and a surrounding sidewall.

11. An infant care device, comprising:

a base housing a main controller, a patient bed assembly including electronic hardware for use in caring for a patient, a rotatable bed assembly support coupled to the patient bed assembly and operable to rotate the patient bed assembly relative to the base, the bed assembly support including electronics for providing at least one of a power, signal, control, data, and communication line for the electronic hardware of the patient bed assembly, and a cable connection coupled to the at least one of the power, signal, control, data, and communication line, the cable connection including a slip ring located in the bed assembly support and cables connecting the slip ring to the main controller, wherein the slip ring is configured to permit rotation of the patient bed assembly without tangling the cables.

12. The infant warming device of claim 11, further comprising a heated mattress deployed in the patient bed assembly.

13. The infant care device of claim 12, further comprising a radiant heater head for heating the heated mattress.

14. The infant care device of claim 13, wherein the patient bed assembly includes an infant bed and a surrounding sidewall.

* * * * *